US006907664B2

(12) United States Patent
Tada et al.

(10) Patent No.: US 6,907,664 B2
(45) Date of Patent: Jun. 21, 2005

(54) METHOD FOR MANUFACTURING FUEL INLET

(75) Inventors: Minoru Tada, Mie (JP); Mikio Morinaga, Mie (JP); Hiroshi Kashima, Mie (JP); Takashi Nakamura, Mie (JP)

(73) Assignee: Bestex Kyoei Co., Ltd., Mie (JP)

( * ) Notice: Subject to any disclaimer, the term of this patent is extended or adjusted under 35 U.S.C. 154(b) by 0 days.

(21) Appl. No.: 10/680,948

(22) Filed: Oct. 8, 2003

(65) Prior Publication Data

US 2004/0222270 A1 Nov. 11, 2004

(30) Foreign Application Priority Data

May 8, 2003 (JP) ..... 2003-129731

(51) Int. Cl.[7] ..... B21K 21/08

(52) U.S. Cl. ..... 29/890.142; 29/428; 29/523; 29/558; 29/890.14

(58) Field of Search ..... 29/890.14, 890.142, 29/522.1, 523, 557, 558, 428; 72/370.04, 370.06, 370.03, 370.01, 370.1; 137/587, 588

(56) References Cited

U.S. PATENT DOCUMENTS 6,390,124 B1 * 5/2002 Kido et al. ..... 137/588
6,453,714 B2 * 9/2002 Kido et al. ..... 72/297
6,530,256 B1 * 3/2003 Irie et al. ..... 72/370.1
6,581,433 B2 * 6/2003 Otsuka et al. ..... 72/370.06
6,615,489 B2 * 9/2003 Yoshida et al. ..... 29/890.14
6,651,477 B2 * 11/2003 Humphries et al. ..... 72/370.06
6,757,974 B2 * 7/2004 Kido et al. ..... 29/890.14
6,810,573 B2 * 11/2004 Morinaga et al. ..... 29/458
2004/0231395 A1 * 11/2004 Barber ..... 72/370.06

FOREIGN PATENT DOCUMENTS

JP 2000-334512 12/2000

* cited by examiner

*Primary Examiner*—Essama Omgba
(74) *Attorney, Agent, or Firm*—Carrier, Blackman & Associates, P.C.; Joseph P. Carrier; William D. Blackman

(57) ABSTRACT

A method for manufacturing a fuel inlet having a good sealing property and a screw structure formed in a precise position involves expanding one end of a long-length stainless pipe (metal pipe) using a cored bar, the tip of the expanded portion which becomes non-uniform as a result of the expanding step is cut off, a screw structure is formed in the expanded portion by using a punch, the tip of the expanded portion which becomes non-uniform as a result of the screw structure forming step is cut off, and thereafter curl forming is conducted to the end of the expanded portion which becomes uniform by using a die so as to provide a seal portion.

9 Claims, 8 Drawing Sheets

(b)

(a)

(a)

(b)

(a)

(b)

(a)

(b)

(a)

(b)

METHOD FOR MANUFACTURING FUEL INLET

BACKGROUND OF THE INVENTION

1. Field of the Invention

The present invention relates to a method for manufacturing a fuel inlet (fuel feed pipe) for feeding fuel such as gas to a fuel tank of a motor vehicle or the like.

2. Description of the Background Art

Conventionally, an inlet pipe which constitutes a fuel inlet has a shape in which one end of the pipe is eccentrically expanded so that a fuel feed nozzle can be inserted therein, a screw structure is formed in this expanded portion so that a cap can be attached thereto, and a seal portion is formed by curling the end of the expanded portion so as to prevent fuel from leaking between the inside surface of the cap. See, for example, Japanese Patent Application Publication 2000 334512 ('D1'hereinafter).

The conventional fuel inlet in which a screw structure is formed in an expanded end portion has the following drawbacks:

The end portion becomes non-uniform in thickness or is partially extended in the course of the expanding process. If a screw structure is formed in such a non-uniform portion, the groove portion of the screw structure has an extremely thin thickness or is deformed.

The screw structure formed in the conventional fuel inlet often has a double-start thread structure so that a cap can be attached or removed quickly. The double-start thread structure is obtained by punch (cam-shaped) forming or roll forming as disclosed in the above-mentioned D1. As shown in FIG. 11(*a*), in a case where the groove portions of the screw structure are formed to overlap with respect to each other, the amount of the material is small in the overlapping area and the seal portion is partially dented in the axial direction. As shown in FIG. 11(*b*), in a case where the groove portions of the screw structure are formed apart with respect to each other, the amount of the material is large and the seal portion is extended in the axial direction. It might be possible to form the groove portions without overlapping or separating, however this is not always possible depending on the relation to the cap.

SUMMARY OF THE INVENTION

To solve the above-mentioned problems, according to a first aspect of the present invention, there is provided a method for manufacturing a fuel inlet comprising the steps of expanding one end of a long-length metal pipe (stainless pipe), cutting off the tip of a long-length metal pipe which has becomes non-uniform as a result of the expanding step, forming a screw structure in the one end of the long-length metal pipe, cutting off a tip of the long-length metal pipe which has becomes non-uniform as a result of the screw structure forming step, and curling the one end of the long-length metal pipe such that it becomes uniform so as to provide a seal portion.

According to a second aspect of the present invention, there is provided a method for manufacturing a fuel inlet comprising the steps of preparing a short-length metal pipe (stainless pipe), one end of which has a small diameter and the other end of which has a large diameter, by conducting a drawing process to a plate or conducting a drawing process or an expanding process to a short-length metal pipe, cutting off a tip of the end having a large diameter which has becomes non-uniform, forming a screw structure in the end having a large diameter after the non-uniform tip has been cut off, cutting off a tip of the short-length metal pipe which has becomes non-uniform as a result of the screw structure forming step, curling the end of the short-length metal pipe such that it becomes uniform so as to provide a fuel feed nozzle retaining bracket having a seal portion, and welding the fuel feed nozzle retaining bracket to a long-length metal pipe, one end of which has been expanded.

By cutting off the non-uniform tip of the pipe prior to forming a screw structure, it is possible to form a screw structure in a precise position. Also, it is possible to eliminate the drawback that the thickness of the groove portion of the screw structure will be extremely thin.

By cutting off the non-uniform tip of the pipe prior to providing a seal portion, it is possible to eliminate the drawback that the seal portion will be partially dented or extended in the circumferential direction.

It is preferable to cut off the tip of the pipe from the inside diameter side toward the outside diameter side especially in the second cutting-off step. By doing so, when curl forming is conducted to the inlet pipe, any resulting burr is located in the inside of the curl, and thus, human hands are protected from directly contacting with the burr. Also, there is no fear that the burr will be pinched even if a pipe expanding method having more processes is conducted.

The screw structure formed in the present invention is not limited to a double-start thread structure, however it should be noted that the present invention is most effective in a case of a double-start thread structure. As a method for forming a double-start thread structure, it is most suitable to form a double-start thread structure by using a main-forming punch and a sub-forming punch in which preliminary forming is conducted by using the sub-forming punch, and thereafter the main-forming punch is advanced.

Further, it is preferable to divide the seal portion providing step into preliminary forming and finishing forming in which the preliminary forming is conducted in a state where a retaining die is partially inserted into the screw structure and the finishing forming is conducted by using convex and concave dies.

BRIEF DESCRIPTION OF THE DRAWINGS

The above and other objects, features and advantages of the present invention will become more apparent from the following description when taken in conjunction with the accompanying drawings.

DETAILED DESCRIPTION OF THE PREFERRED EMBODIMENTS

Figure 1:
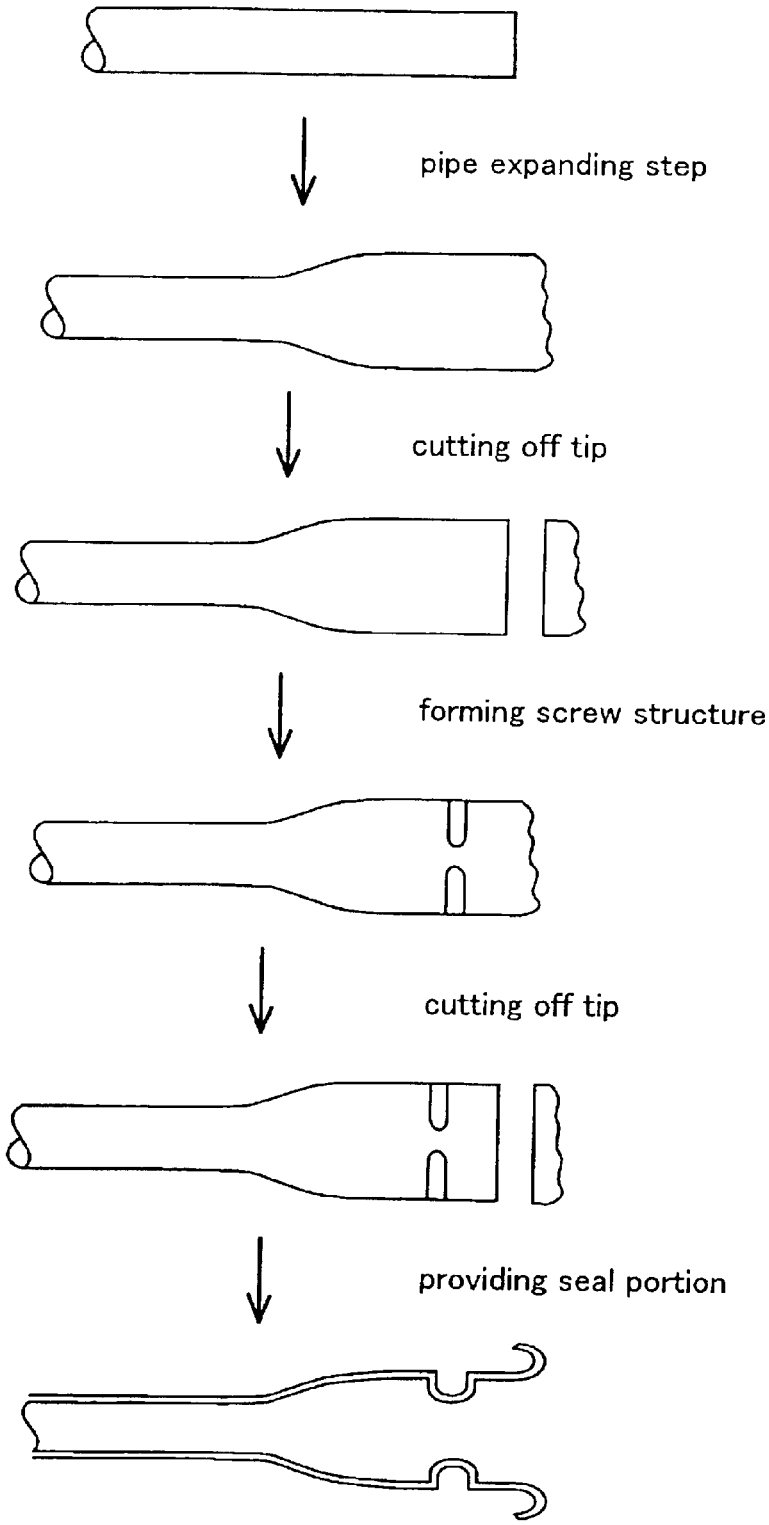
FIG. 1 is a diagram showing an overall fuel inlet manufacturing process according to the invention.

Preferred embodiments of the present invention will now be described with reference to the accompanying drawings. FIG. 1 is a diagram showing all processes in a summary of the method for manufacturing a fuel inlet according to the present invention, and will be explained below.

First, a long-length stainless pipe (metal pipe) is prepared, and one end of this pipe is expanded e.g., by using a cored bar.

Next, the tip of the expanded portion which has becomes non-uniform as a result of the above expanding step is cut off, and thereafter a screw structure is formed in the expanded portion by using a punch.

Finally, the tip of the expanded portion which has becomes non-uniform as a result of the formation of the screw structure is cut off, and thereafter curl forming is conducted to the tip of the expanded portion which becomes uniform by using a die to provide a seal portion.

Figure 2:
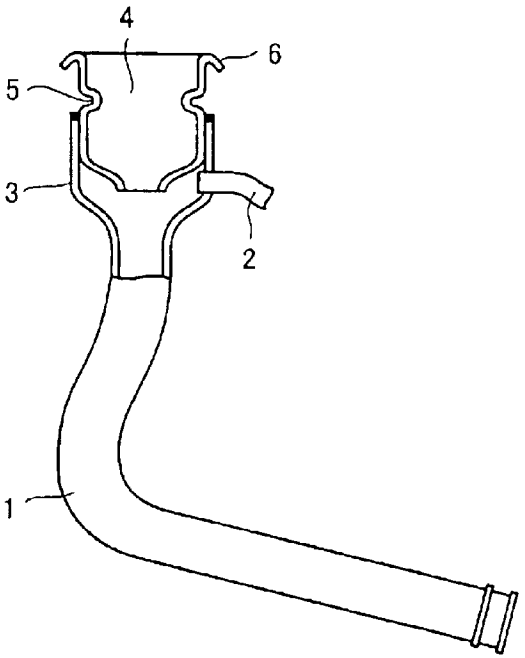
FIGS. 2(*a*) and (*b*) are partly sectional side views of an entire fuel inlet.
Figure 2:
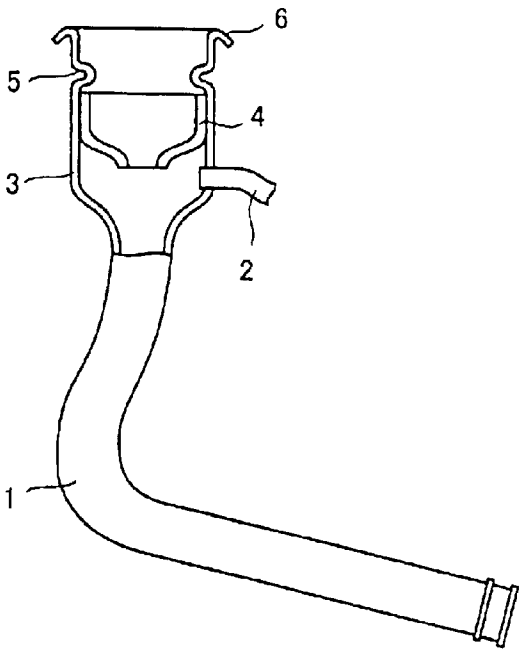

FIGS. 2(*a*) and (*b*) are partly sectional side views of an entire fuel inlet manufactured according to the present invention.

FIG. 2(*a*) shows a case where a screw structure is formed in the pipe body. The fuel inlet is comprised of a stainless inlet pipe 1 and a stainless breather pipe 2 welded to the inlet pipe 1. One end of the inlet pipe 1 is expanded so as to form an expanded portion 3, and a fuel feed nozzle retaining bracket 4 is spot-welded to the inside of the expanded portion 3. A (double-start) screw structure 5 is formed in the expanded portion 3, and a seal portion 6 is formed by curling the tip of the expanded portion 3.

FIG. 2(*b*) shows a case where a screw structure is not formed in the inlet pipe 1. In this case, the screw structure 5 and the seal portion 6 are formed in the fuel feed nozzle retaining bracket 4, and the fuel feed nozzle retaining bracket 4 is arc-welded to the inlet pipe 1.

Next, each process will be explained in detail.

Figure 3:
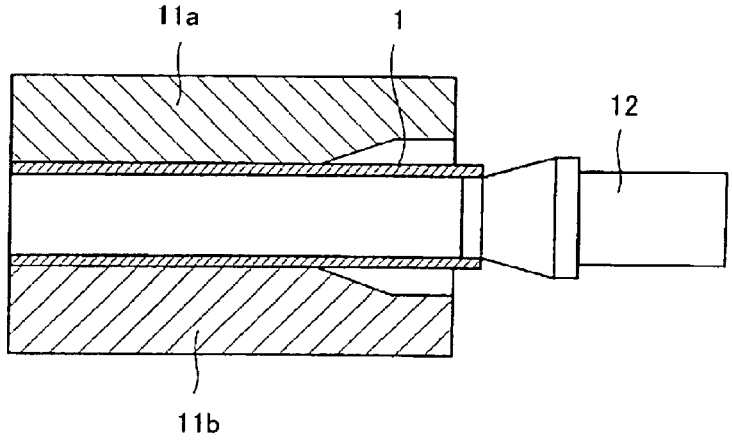
FIG. 3 is a sectional side view explaining an expanding step according to the present invention.

In the expanding step, a pair of clamping dies 11*a*, 11*b*, and a pipe expanding punch 12 are used as shown in FIG. 3. The circumference of the pipe 1 is sandwiched and clamped in a concave groove of a semi-cylindrical shape defined by the clamping dies 11*a* and 11*b*. The pipe expanding punch 12, the end of which has a tapered shape, is press-fitted into the pipe 1, and thereby an expanded portion 3 is formed in one end of the pipe 1.

Figure 4:
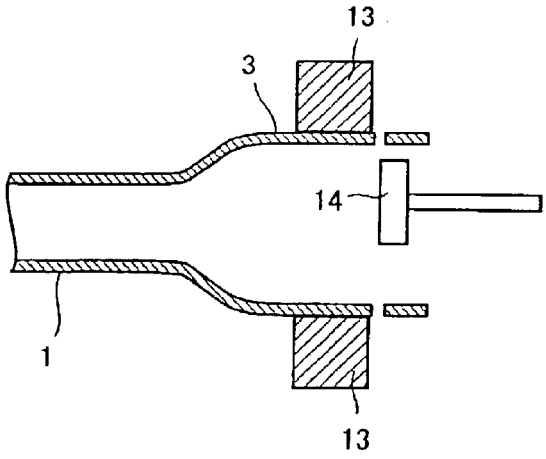
FIG. 4 is a sectional side view explaining a tip cutting-off step according to the present invention.

In the tip cutting-off step subsequent to the expanding step, the tip which becomes non-uniform is cut off from the inside diameter side by using a knife 14 in a state where the expanded portion 3 of the pipe 1 is retained by another clamping die 13 as shown in FIG. 4.

Figure 5:
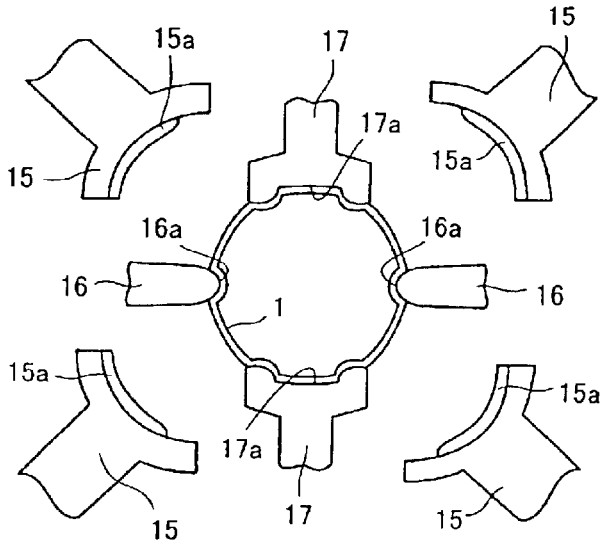
FIGS. 5(*a*) and (*b*) are plan views explaining a screw structure forming step according to one embodiment of the present invention.
Figure 5:
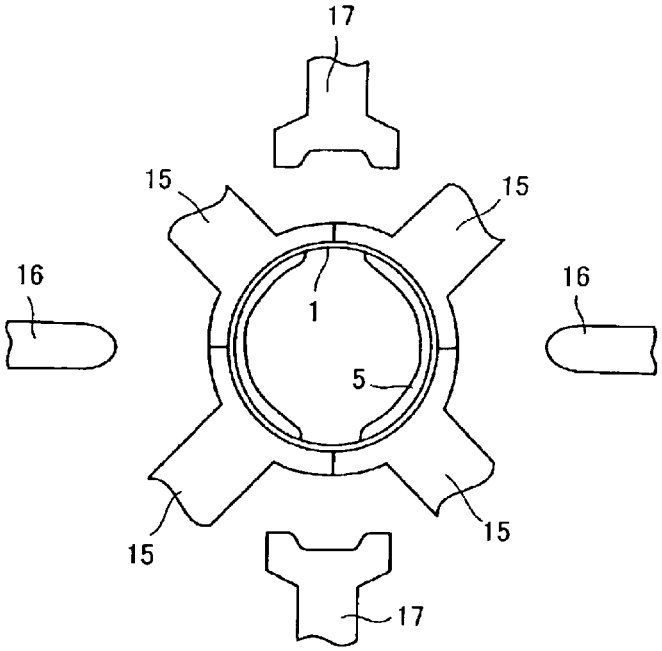

Next, a double-start thread structure 5 is formed in the expanded portion 3, for example, by cam forming. As shown in FIG. 5, a screw structure forming apparatus is comprised of four main-forming punches 15, a pair of sub-forming punches 16 and another pair of sub-forming punches 17. The main-forming punches 15, the sub-forming punches 16 and the sub-forming punches 17 are individually movable back and forth with respect to the center of the pipe 1, which is set in the proper position, by a hydraulic cylinder unit or the like.

The main-forming punches 15 are in an open state when they are away from the center, are in a closed state when they move to the centers and each punch abuts with the adjacent punches. The main-forming punches 15 have a forming edge 15*a*, and the radius of curvature of the forming edge 15*a* is equal to that of the groove portion of the screw structure to be formed. Also, the sub-forming punches 16 and the sub-forming punches 17 which are disposed between the main-forming punches 15 have a forming edge 16*a* and 17*a* respectively. The forming edge 16*a* has a round shape, and the forming edge 17*a* has the same shape as a portion to be left without being formed.

In order to form a double-start thread structure in the expanded portion 3 by using the above-mentioned screw structure forming apparatus, the sub-forming punches 16 and 17 are advanced without moving the main-forming punches 15, and thereby preliminary forming is conducted so that the expanded portion 3 is partially dented inward with respect the radial direction as shown in FIG. 5(*a*).

Next, as shown in FIG. 5(*b*), the sub-forming punches 16 and 17 are moved back, the main-forming punches 15 are advanced, and thereby a screw structure 5, 5 is formed on the circumference of the expanded portion 3, the screws of the screw structure 5, 5 being shifted by 180 degrees in the phase with respect to each other.

Figure 6:
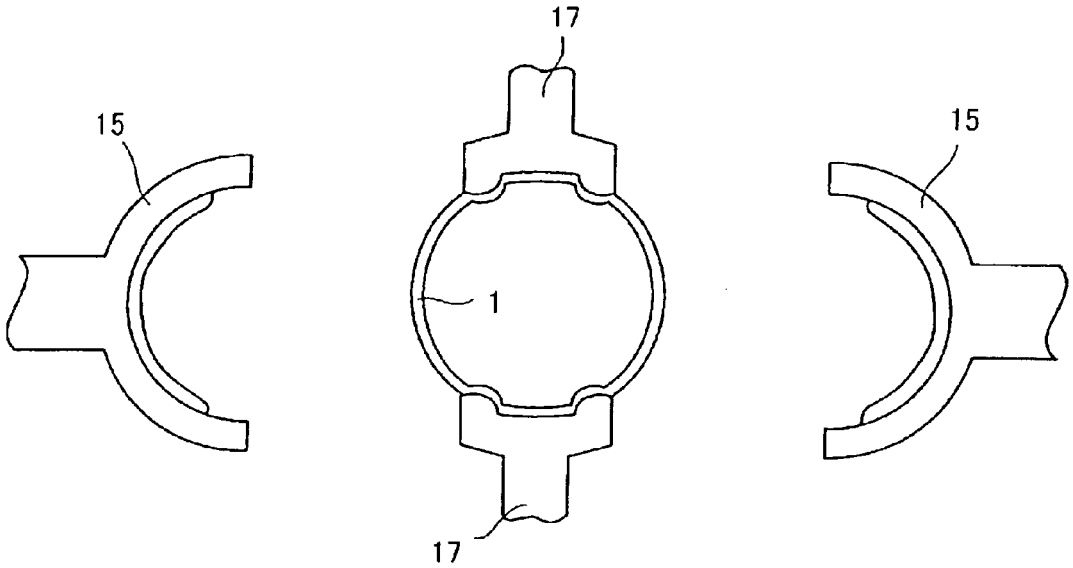
FIGS. 6(*a*) and (*b*) are plan views explaining another embodiment of the screw structure forming step according to the present invention.
Figure 6:
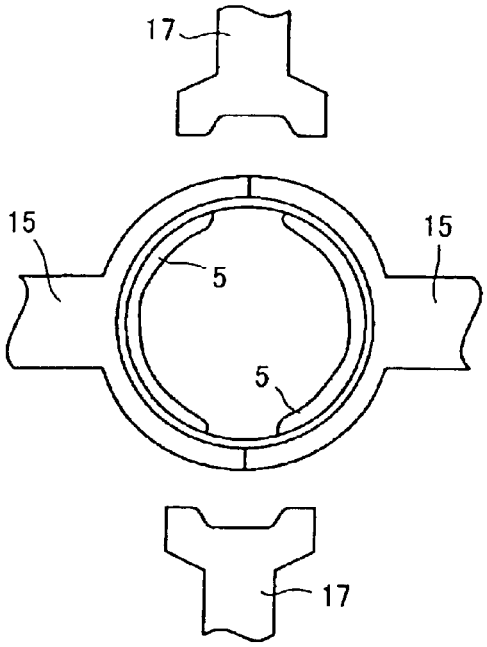
Figure 7:
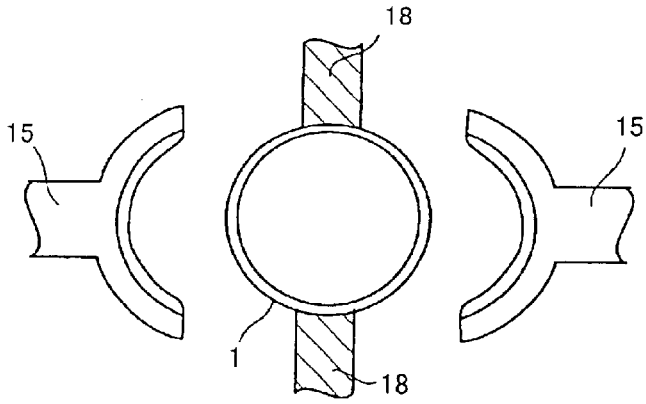
FIGS. 7(*a*) and (*b*) are plan views explaining still another embodiment of the screw structure forming step according to the present invention.
Figure 7:
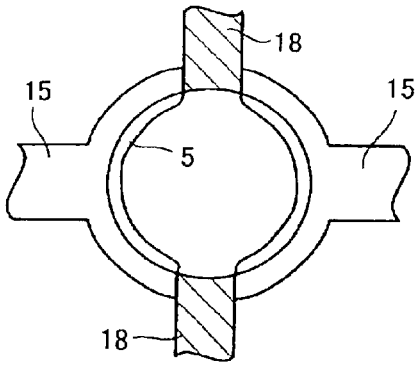
Figure 8:
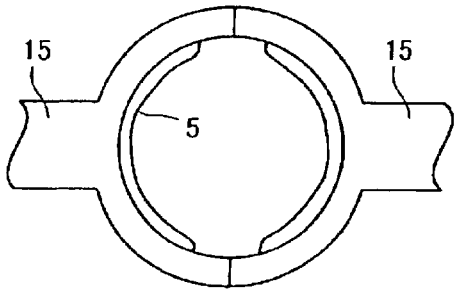
FIG. 8 is a plan view explaining yet another embodiment of the screw structure forming step according to the present invention.

FIGS. 6–8 show another embodiment of the screw structure forming appartus. In the embodiment shown in FIG. 6, the screw structure forming apparatus is comprised of a pair of main-forming punches 15 and a pair of sub-forming punches 17 for leaving a portion without being formed. In this embodiment, a portion to be left without being formed is pre-formed by advancing the sub-forming punches 17 as shown in FIG. 6(*a*), and thereafter a screw structure 5, 5 is formed by advancing the main-forming punches 15 as shown in FIG. 6(*b*).

In the embodiment shown in FIG. 7, the screw structure forming apparatus is comprised of a pair of main-forming punches 15 and a pair of sub-forming punches 18 for maintaining the outside diameter of the expanded portion 3. In this embodiment, the sub-forming punches 18 are allowed to abut against the circumference of the expanded portion 3 in advance as shown in FIG. 7(*a*), and thereafter a screw structure 5, 5 is formed by advancing the main-forming punches 15 as shown in FIG. 7(*b*).

In the embodiment shown in FIG. 8, the screw structure forming apparatus is comprised of just a pair of main-forming punches 15, and a screw structure 5, 5 is formed by advancing the main-forming punches 15.

After the above-mentioned screw structure forming step is finished, the tip of the expanded portion 3 which becomes non-uniform as a result of the screw structure forming step is cut off in the same manner as mentioned above. Next, a seal portion 6 is formed.

Figure 9:
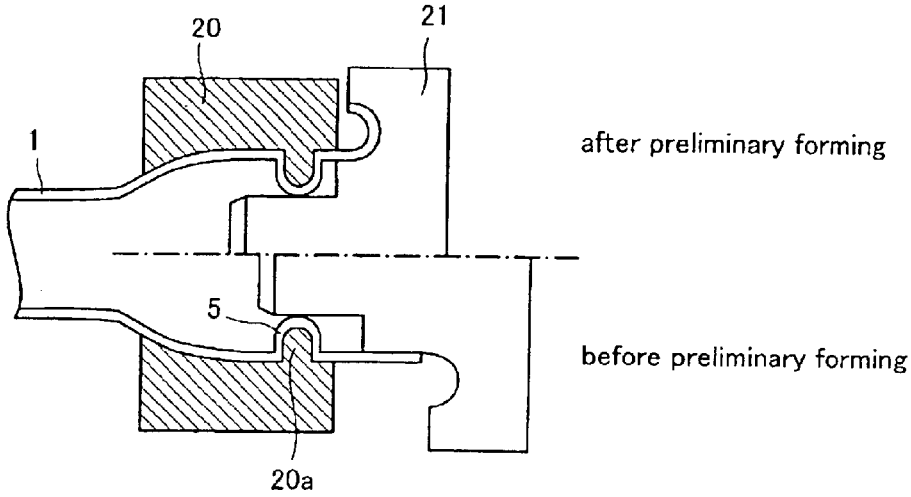
FIG. 9 is a sectional side views explaining a preliminary forming process for providing a seal portion according to the present invention.
Figure 10:
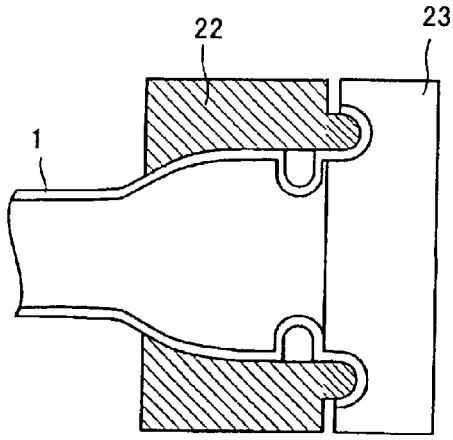
FIG. 10 is a sectional side view explaining a finishing forming process for providing a seal portion according to the present invention.
Figure 11:
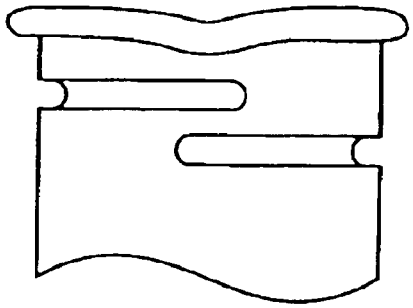
FIG. 11 prior art
FIGS. 11(*a*) and (*b*) are sectional side views explaining a drawback caused in a case where the conventional method is employed.
Figure 11:
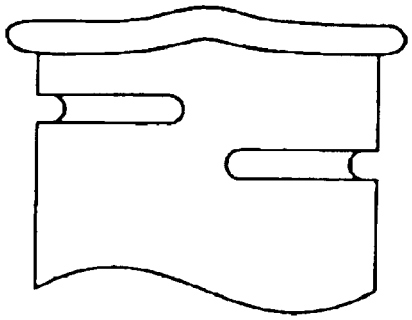
FIG. 11 prior art

Prior to forming the seal portion 6, preliminary forming is conducted as shown in FIG. 9. In the preliminary forming, a clamping die 20 and a cored bar 21 are used, and the tip of the expanded portion 3 is curled in a state where a projection 20*a* which has been provided in the clamping die 20 is inserted into the groove portion of the screw structure 5. By inserting the projection 20*a* into the groove portion of the screw structure 5, it is possible to prevent the screw structure from being damaged during the curling. After the preliminary forming is completed, finishing forming is conducted by using a convex die 22 and a concave die 23 as shown in FIG. 10.

In the above-mentioned embodiment, the screw structure is formed in the inlet pipe 1. However, it is also possible to form the screw structure in the fuel feed nozzle retaining bracket 4. In such a case, the screw structure is formed in the fuel feed nozzle retaining bracket 4 in advance, and thereafter the fuel feed nozzle retaining bracket 4 is welded to the inlet pipe 1.

In this connection, the fuel feed retaining bracket 4 is obtained by conducting a drawing process to a plate or conducting a drawing process or an expanding process to a short-length metal pipe.

As mentioned in the above, according to the present invention, when a fuel inlet is manufactured, it is possible to form a screw structure in a precise position by cutting off the tip of the pipe, which has become non-uniform as a result of the pipe expanding step, prior to forming the screw structure. Also, it is possible to eliminate the drawback that the thickness of the groove portion of the screw structure will be extremely thin. Further, by cutting off the tip, which has become non-uniform as a result of the screw structure forming step, prior to forming a seal portion, it is possible to eliminate the drawback that the seal portion is partially dented or extended in the circumferential direction. Consequently, a fuel inlet having a good sealing property can be obtained according to the present invention.

Although there have been described in detail what are the present embodiments of the invention, it will be understood that variations and modifications may be made thereto without departing from the spirit or scope of the invention as indicated in the appended claims.

What is claimed is:

1. A method for manufacturing a fuel inlet comprising the steps of:

expanding one end of a long-length metal pipe;

cutting off a tip of the long-length metal pipe which has becomes non-uniform as a result of said expanding step;

forming a crew structure in the expanded end of the long-length metal pipe;

cutting off a tip of the long-length metal pipe which has becomes non-uniform as a result of said screw structure forming step; and curling the expanded end of the long-length metal pipe which has become uniform so as to provide a seal portion.

2. The method of claim 1, wherein said screw structure is a double-start thread structure.

3. The method of claim 2, wherein said double-start thread structure is formed using a main-forming punch and a sub-forming punch in which preliminary forming is conducted by using said sub-forming punch, and thereafter said main-forming punch is advanced to form said double-start thread structure.

4. The method of claim 1, wherein said seal portion providing step is comprised of preliminary forming and finishing forming in which said preliminary forming is conducted in a state where a retaining die is partially inserted into the screw structure and said finishing forming is conducted by using convex and concave dies.

5. The method of claim 1, wherein said metal pipe is formed of stainless steel.

6. A method for manufacturing a fuel inlet comprising the steps of:

preparing a short-length metal pipe, one end of which has a small diameter and the other end of which has a large diameter, by conducting a drawing process or an expanding process to the short-length metal pipe;

cutting off a tip of the large diameter end of the short-length metal pipe which has become non-uniform;

forming a screw structure in the large diameter end of the short-length metal pipe in which the non-uniform tip has been cut off;

cutting off a tip of the short-length metal pipe which has becomes non-uniform as a result of said screw structure forming step;

curling the large diameter end of the short-length metal pipe which has become uniform so as to provide a fuel feed nozzle retaining bracket having a seal portion; and welding said fuel feed nozzle retaining bracket to a long-length metal pipe one end of which has been expanded.

7. The method of claim 6, wherein said screw structure is a double-start thread structure.

8. The method of claim 7, wherein said double-start thread structure is formed using a main-forming punch and a sub-forming punch in which preliminary forming is conducted by using said sub-forming punch, and thereafter said main-forming punch is advanced to form said double-start thread structure.

9. Thc method of claim 6, wherein said short-length and long-length metal pipes are formed of stainless steel.

* * * * *

UNITED STATES PATENT AND TRADEMARK OFFICE

CERTIFICATE OF CORRECTION

PATENT NO. : 6,907,664 B2
DATED : June 21, 2005
INVENTOR(S) : Minoru Tada et al.

It is certified that error appears in the above-identified patent and that said Letters Patent is hereby corrected as shown below:

Column 1,
Lines 19-20, change "Publication 2000 334512" to -- Publication 2000-334512 --.
Lines 53 and 56, change "has becomes non-uniform" to -- has become non-uniform --.

Column 2,
Line 1, change "becomes non-uniform" to -- become non-uniform --.
Line 4, change "has becomes non-uniform" to -- has become non-uniform --.

Column 3,
Line 1, change "side views explaining" to -- side view explaining --.
Line 21, change "has becomes non-uniform" to -- has become non-uniform --.
Line 27, change "becomes non-uniform" to -- become non-uniform --.

Column 4,
Line 8, change "to the centers and each" to -- to the center, and each --.
Line 32, change "show another embodiment of the" to -- show other embodiments of the --.

Column 5,
Line 41, change "becomes non-uniform" to -- become non-uniform --.
Line 43, change "a crew structure" to -- a screw structure --.
Lines 46-47, change "which has becomes" to -- which has become --.

Column 6,
Line 31, change "becomes non-uniform" to -- become non-uniform --.
Line 38, change "pipe one end" to -- pipe, one end --.

Signed and Sealed this

Twenty-first Day of March, 2006

JON W. DUDAS
*Director of the United States Patent and Trademark Office*